US007836643B2

(12) United States Patent
Walch

(10) Patent No.: US 7,836,643 B2
(45) Date of Patent: Nov. 23, 2010

(54) WINDOW

(75) Inventor: Christian Walch, Ludesch (AT)

(73) Assignee: Walch AG, Eschen (LI)

( * ) Notice: Subject to any disclaimer, the term of this patent is extended or adjusted under 35 U.S.C. 154(b) by 886 days.

(21) Appl. No.: 11/665,904

(22) PCT Filed: Oct. 20, 2005

(86) PCT No.: PCT/CH2005/000615

§ 371 (c)(1),
(2), (4) Date: Apr. 20, 2007

(87) PCT Pub. No.: WO2006/042437

PCT Pub. Date: Apr. 27, 2006

(65) Prior Publication Data

US 2008/0104904 A1 May 8, 2008

(30) Foreign Application Priority Data

Oct. 20, 2004 (CH) ..... 1738/04

(51) Int. Cl.
*E06B 3/66* (2006.01)

(52) U.S. Cl. ..... 52/204.593; 52/204.62; 52/204.591; 52/204.55

(58) Field of Classification Search ..... 52/204.51, 52/204.54, 204.591, 204.593, 204.597, 204.62
See application file for complete search history.

(56) References Cited

U.S. PATENT DOCUMENTS 5,653,073 A * 8/1997 Palmer ..... 52/204.593
6,055,783 A 5/2000 Guhl et al.
6,164,715 A * 12/2000 Mosaner ..... 296/146.1
6,312,043 B1 * 11/2001 Blackburn et al. ..... 296/146.16
6,412,225 B1 * 7/2002 McManus ..... 49/381
6,941,700 B1 9/2005 Kobrehel et al.

FOREIGN PATENT DOCUMENTS

| | | |
|---|---|---|
| DE | U 200 10 289 | 8/2000 |
| DE | 100 59 849 | 5/2001 |
| DE | A 101 32 356 | 1/2003 |
| DE | 101 57 646 | 6/2003 |
| NL | A 9 300 377 | 10/1994 |

* cited by examiner

*Primary Examiner*—Richard E Chilcot, Jr.
*Assistant Examiner*—Alp Akbasli
(74) *Attorney, Agent, or Firm*—Morriss O'Bryant Compagni, P.C.

(57) ABSTRACT

The invention relates to a window (11, 11*a*), which can be opened in an outward manner, comprising a casement (13) and stepped glazing (15) which is received in the casement (13). The stepped glazing (15) comprises at least two window panes (19, 23) which are arranged at a distance from each other, said window panes being an inner pane and an outer pane. The casement (13) is essentially formed by an L-shaped casement profile (25) having a first and a second extremity (27, 29). The inner window pane (19) is arranged on the side of the first extremity (27) of the casement profile (25) which is oriented towards the glazing and is rigidly connected thereto by means of a first adhesive connection (33). The outer window pane (23) of the stepped glazing is rigidly connected to the front side (31) of the casement profile (25) which is oriented in an outward manner by means of a second adhesive connection (35). The layer thickness of the second adhesive connection (35) is greater than the first adhesive connection (33). The first adhesive connection (33) is achieved in an advantageous manner by an adhesive strip and the second by a liquid adhesive material.

21 Claims, 4 Drawing Sheets

WINDOW

This application claims priority to International Application PCT/CH2005/000615 filed Oct. 20, 2005 and Swiss Patent Application No. 1738/04 filed on Oct. 20, 2004, the entirety of each of which is incorporated by

FIELD OF THE INVENTION

The present invention relates to a window sash according to the preamble of Claim 1, to a window system according to the preamble of either Claim 12 or Claim 22 and to a method for the manufacture thereof.

PRIOR ART

In conventional wooden, metal or plastics material windows, the glazing consisting of two or three panes is generally held by the casement. The casement extends in this case internally and externally over the edge of the glazing, so the glazing is fixedly engaged by the frame.

Windows in which the glazing is additionally bonded to the casement have also recently appeared on the market. However, these adhesive connections are always used in combination with other interlocking frame/window connections. Windows with adhesive connections between the glass and casement are generally metal windows. One reason for this might be that the adhesives used do not ensure a reliable and durable connection to other materials such as, for example, wood. The adhesive used in the aforementioned windows is a silicone-based adhesive which still has a certain resilience even when cured.

In recent years, increasing use has been made in house building of outwardly opening windows. The term "an outwardly opening window" refers, in the context of the present invention, to a window in which the window is pivoted about a horizontal pivot axis for opening, the pivot axis being moved away from the casement. Windows which open outward in this way have the advantage that when the window is positioned obliquely, fresh air flows quickly and in large amounts into the room. It is also advantageous that the opened window sash does not project into the room and take up space. As far as design is concerned, outwardly opening windows are preferred by architects on account of their filigree configuration. The use of stepped glass also allows the casement to be concealed, so windows of this type can, for example, be used in solid glass facades. The drawback of the commercially available outwardly opening windows is often their complex construction and the high price associated therewith.

Raico Bautechnik GmbH, Pfaffenhofen, Germany supplies under the trade name "Raicowing" an outwardly opening top-hung window. The aforementioned top-hung window has a metal casement and a window frame consisting of extruded aluminium profiles. A locking system adapted to the metal frame is provided on the casement.

U.S. Pat. No. 6,055,783 teaches the manufacture of a window sash in which the glass panes are incorporated directly into a frame construction without insulating glazing first being produced, thus allowing the use of separate spacers for the glass panes to be dispensed with. This is achieved in that use is made of a support construction which has a first receiving surface for securing thereto the outer edge of the outside of a first glass pane and a second receiving surface for securing thereto the outer edge of the inside of a second glass pane. Both glass panes are carried merely by these receiving surfaces.

NL-A-9 300 377 discloses a window or door construction consisting of a frame and insulating glazing which consists of two windowpanes and is connected to the frame. The insulating glazing is what is known as stepped glass in which the outer windowpane is larger than the inner windowpane. The frame has a stepped rebate in which the stepped glass is inserted. The stepped glass is connected to the frame by means of a single adhesive connection located between the outer windowpane and the end face of the frame. The frame of the window can be made of wood. To protect the adhesive connection from insolation, the outer glass panel is coated either internally or externally with an enamel layer. NL-A-9 300 377 does not provide any more detailed information concerning the window construction and also does not indicate any suitable adhesives.

DE-A-101 32 356 relates to a glass sliding cover or a glass door comprising a frame enclosing the glass panel, the glass panel being bonded to the frame. The frame and glass panel are bonded by means of a jelly-like adhesive strip. This has the advantage that the bonding points are sufficiently clean and therefore do not have to be concealed for visual reasons.

German utility model DE-U-200 10 289 relates to a window or door frame comprising insulating glazing which is provided on the outside of the frame and is connected to the casement exclusively by bonding. The outer pane of the insulating glazing protrudes on all sides relative to the inner pane, thus forming a stepped rebate. The stepped rebate of the insulating glazing is inserted into a frame rebate provided on the outside of the frame. Fastening rails, which are bonded to the edge on the inside of the outer pane, are used for fastening the insulating glazing to the frame legs. The fastening rails have an undercut groove with which rotatable hammerhead-like clamping closure means can engage. The clamping closure means are secured to the frame profile. The insulating glazing is thus connected to the frame profile via the fastening rails and the clamping closure means. There is no direct adhesive connection between the insulating glazing and frame.

Object

The object of the present invention is to propose an, especially outwardly opening, window, in particular a wooden window, and a method for the manufacture thereof, which are cost-effective. A further aim is to provide a window having a high insulating value. Another aim is to provide a window having a very appealing design. The design and structure of the window should also make it well equipped for high mechanical and constructional/physical demands.

According to the invention, a window sash according to the preamble of Claim 1 is characterised in that the casement is formed substantially by an L-shaped profile having a first and a second leg, the first legs of opposing casement profiles being oriented toward one another, and in that the stepped glazing is connected to the L-shaped profile by an adhesive connection. A characteristic of the sash window according to the invention is that the outside of the inner windowpane of the stepped glazing is rigidly connected to the first leg of the casement profile by an inner adhesive connection. This contributes to a high rigidity and warp resistance of the window. The inner adhesive connection is exposed to lower fluctuations in temperature than the outer adhesive connection. The inner adhesive connection can therefore have lower resilience than is required by the outer adhesive connection, and this increases the rigidity in connection between the casement and glazing.

The chosen connecting process also allows the construction of a structurally highly simple window which can be manufactured cost-effectively. Compared to conventional windows, the new design eliminates the need for wedging of the glazing in the casement. Nor is it necessary for the casement to form an interlocking fit with the glazing.

Advantageously, the inner windowpane is rigidly connected to the first leg of the L-shaped profile by means of an adhesive connection which has lower resilience than the outer adhesive connection. In stepped glass, the outer windowpane has a projection relative to the inner windowpane. As a result of the use of the stepped glass window, the frame is invisible from the outside, and this is valued particularly highly by architects. Between this frame and the outer windowpane of the stepped glass there is advantageously provided an adhesive connection having higher resilience than the inner adhesive connection.

Differing resiliencies can be achieved as a result of the choice of material of the adhesive and as a result of the layer thickness of the adhesive.

Bonding using a relatively flexible adhesive can be regarded as being a standard form of bonding. This improves the soundproofing of the window system compared to less flexible adhesives. This adhesive is defined by way of the combined tension and shear resistance which is in a range of from 1 to 3 MPa.

Alternatively, a less flexible adhesive can be used for increased requirements with regard to the combined tension and shear resistance of the adhesive connection. Adhesives of this type have a combined tension and shear resistance in the range of from 9 to 12 MPa. Their resilience is classified by Shore hardness A 90 and D 50. For special applications and special solutions, adhesives having still higher combined tension and shear resistance can be used.

Advantageously, the adhesive connection, in particular the outer adhesive connection, is formed by a heat-reactive polyurethane adhesive or preferably by an acrylate reactive adhesive. The use of a heat-reactive polyurethane adhesive has the surprising advantage of allowing permanent and rigid wood/glass connections to be produced. According to a preferred embodiment, the adhesive connection, in particular the inner adhesive connection, is formed by a double-sided adhesive strip. The double-sided adhesive strip has the advantage of simpler handling compared to liquid adhesives. An adhesive strip allows an extremely clean-looking adhesive connection of constant quality to be achieved. There are also adhesive strips that are every bit as good as liquid adhesives with regard to adhesive strength and durability. According to an advantageous embodiment, the adhesive strip is made from a foamed plastics material, for example polyurethane or silicone. Suitable adhesive layers, based for example on acrylate or the like, can be attached to the foamed plastics material strip on either side.

Advantageously, the edge of the outer windowpane is provided with an opaque layer or coating, at least in the region of the at least one adhesive connection, thus allowing ageing of or damage to the adhesive connection by UV radiation to be avoided. According to a particularly advantageous embodiment, the stepped glass is rigidly connected to the first leg by means of a first, less resilient adhesive connection and to the end face of the second leg of the L-shaped profile by means of a second, more resilient adhesive connection. This provides a particularly stable bond between the stepped glass and the casement, allowing additional fastening means for fastening the windowpane to the frame to be dispensed with. The relatively rigid inner adhesive connection also allows the casement to be made of profiles having very small cross sections, as the bonded-in glazing imparts stability to the casement.

An end edge of the first leg of the casement profile extends along the inner windowpane. Between this end edge and the windowpane there is expediently provided a rebate in which a sealing strip is received. This ensures effective sealing of the window toward the room side. However, if the adhesive connection is chosen appropriately, this seal can be superfluous.

Advantageously, the rebate depth defined by the L-shaped profile is smaller than the thickness of the stepped glazing, which is composed of a plurality of windowpanes, less the thickness of the outer windowpane. This provides, between the end face of the second leg and the protruding edge of the stepped glazing, a gap which can be filled with an adhesive to form the second, outer adhesive connection. The introduced adhesive forms a thicker layer of adhesive, and therefore one tending to be more resilient, than the inner adhesive connection.

A space remaining between the leg of the L-shaped profile and the stepped glazing is expediently filled with an insulating material, thus allowing a cold bridge to be avoided in this region. This space can also be vented to facilitate a moisture balance with the environment.

The construction according to the invention of the window is especially suitable in connection with a wooden or plastics material frame. The plastics material frame can in this case be reinforced by metal profiles. The window sash can be pivotably articulated to a window frame in a known manner by means of window fittings. The length and width of the window frame preferably substantially correspond in this case to the length and width of the outer windowpane. This has the advantage that the window fittings are protected from atmospheric influences.

The window frame is advantageously formed by an L-shaped window frame profile. This is a window frame that can be manufactured cost-effectively. Between the soffit of the L-shaped window frame profile and the L-shaped casement profile there is expediently provided an interval in which the window fittings are received.

According to a particularly preferred embodiment, in the closed position, a projection of the outer windowpane abuts the end face of the L-shaped window frame profile. This provides a window system which can easily be fitted into a wall soffit. A sealing path is expediently provided on the inside of the projection. The sealing path ensures effective sealing of the window. Grooves for receiving sealing strips are preferably provided on the side of the base leg of the window frame profile that is oriented toward the windowpane. These seals can be of simple design and therefore cost-effective.

A preferred embodiment provides for the inner casement soffit to align with the inner soffit of the window frame. As a result, the casement is also concealed by the window frame when the window is closed. This also opens up new possibilities in terms of design. As a result of the fact that the opening of the window frame, casement and optionally also the opening of the stepped glazing are identical, a very attractive visual appearance is obtained. This clearance of the window can thus also be of maximum size compared to the clearance of the wall opening in which the window system is integrated.

The present invention also relates to a method for the manufacture of an outwardly opening window by the following method steps:

a) providing a casement profile which is L-shaped in cross section and has a first and a second leg, the first legs of opposing casement profiles being oriented toward one another, and b) stepped glazing which fits into the casement profile and comprises at least two windowpanes, an inner and an outer windowpane, arranged at a distance from one another and c) producing at least one continuous adhesive connection between the stepped glazing and the casement profile, in particular a peripheral inner adhesive connection between the outer face of the inner windowpane and the first leg and an outer adhesive connection between the inside of the outer windowpane and the second leg of the casement profile.

The inner adhesive connection advantageously has lower resilience than the outer adhesive connection.

The method according to the invention for the manufacture of windows is extremely simple and time-saving. The adhesive is preferably applied in this case to the side of the first and the second leg of the L-shaped profile that is oriented toward the windowpane. To the inventors' surprise, it was found that a highly stable and warp-resistant window is obtained, as the strength of the glass used contributes quite considerably to the stability of the window. Further advantageous variations of the method are defined in the sub-claims.

Another variation of the manufacturing method is characterised by the following method steps:

a providing a casement profile which is L-shaped in cross section and has a first and a second leg, the first legs of opposing casement profiles being oriented toward one another, and stepped glazing which fits into the frame and comprises at least two windowpanes, an inner and an outer windowpane, arranged at a distance from one another, the outer windowpane having a protruding edge relative to the inner windowpane;

b applying an adhesive, in particular an adhesive strip, to the first leg of the L-shaped profile for generating a first adhesive connection, c inserting the stepped glazing into the frame; and d introducing a second adhesive layer between the end face of the L-shaped profile and the edge of the outer window pane for generating a second adhesive connection.

Alternatively, the adhesive can be added to the glass before the stepped glazing is inserted into the frame.

An expedient variation provides that for drying and curing adhesive layers, the profile comprising the inserted stepped glass is arranged approximately horizontally. The inherent weight of the stepped window glass allows additional weighting of the window during drying to be dispensed with. Expediently, the surfaces of the frame and the stepped glass that are to be provided with adhesive are coated beforehand with a primer. This ensures an effective connection of the adhesive, on the one hand, to the glass and, on the other hand, to the casement.

The present invention also relates to a window system comprising an outwardly opening, in particular tiltable, window having a casement and a window received in the casement and also a window frame to which the window is articulated about a horizontal axis in the fitted state, which system is characterised in that the window has, on at least two opposing sides, a projection protruding beyond the casement and in that the projection rests against the window frame so as to produce a seal when the window is closed. This window system is basically independent of the design and structure of the window. As a result of the fact that the projection abuts the window frame, the window frame and the fittings arranged between the window frame and the window are completely protected from atmospheric influences. The window glazing used is advantageously stepped glazing comprising at least two windowpanes, an inner and an outer windowpane, arranged at a distance from one another, and the projection is formed by the outer windowpane (four-sided stepped glass).

Advantageous developments of the window system are defined in the sub-claims.

Embodiments of the invention will be described in greater detail hereinafter, by way of example, with reference to the drawings, in which.

Figure 1:
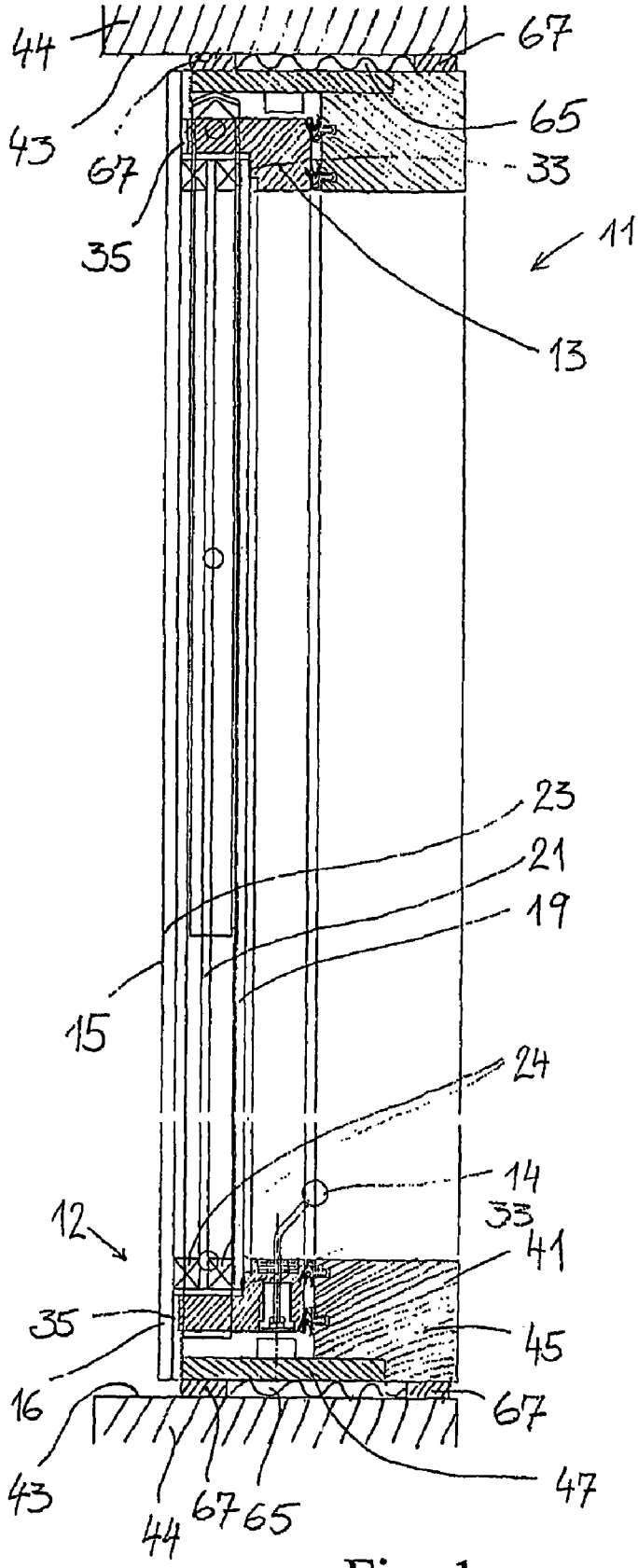
FIG. 1 is a vertical section of a first embodiment of a window system according to the invention integrated into a wall soffit and comprising stepped glazing.
Figure 2:
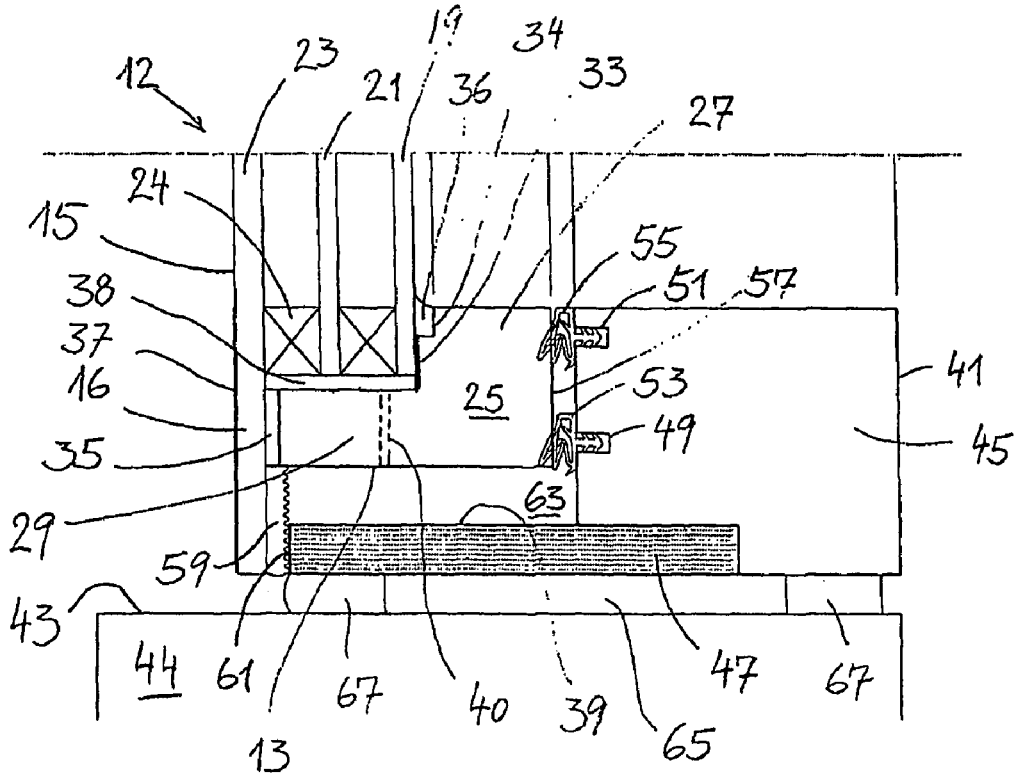
FIG. 2 is a detailed view of certain sections of the construction of the window system.

The window system 11 according to the invention shown in FIG. 1 to 2 comprises a window sash 12 in a window frame 41. The window sash 12 has a casement 13 and stepped glazing 15 inserted into the casement. In the illustrated embodiment, the stepped glazing consists of an inner windowpane 19, a central windowpane 21 and an outer windowpane 23, between which spacers 24 are arranged.

The term "stepped glazing" refers, in the present invention, to window glazing which consists of two or more windowpanes and in which the outer windowpane has an edge 16 projecting beyond the inner windowpane. The protruding edge 16 is configured on at least three sides of the window but preferably on all four sides of the window. The individual windowpanes 19, 21 and 23 are separated from one another by spacers 24 to which they are rigidly connected. The intervals between the windowpanes can be filled with an inert gas, as is known in high-quality windows.

The casement 13 consists substantially of an L-shaped casement profile 25 having a first leg 27 and a second leg 29 located perpendicularly to the first leg 27. The stepped glass 15 rests on the one hand, with the inner windowpane 19, on the side of the first leg 27 that is oriented toward the multiple glazing and on the other hand, with the outer windowpane 23, against the outwardly oriented end face 31 of the second leg 29. The stepped glazing 15 and the casement 13 are connected by means of a suitable adhesive. Adhesives of this type are commercially available. A first adhesive connection 33 between the inner windowpane 19 and the first leg 27 can be produced by a free-flowing adhesive or a double-sided adhesive strip. A second adhesive connection 35 is located between the outer windowpane 23 and the end face 31 of the leg 29. A suitable free-flowing adhesive is preferably used for producing this outer adhesive connection 35. Adhesives of this type are also commercially available.

The adhesive connections 33, 35 securely join the stepped glazing 15 and the casement 13. The mechanical stability of the stepped glazing 15 contributes substantially in this case to the stability of the (composite) window. It is the glazing that imparts stability to the casement 13 via the adhesive connection. The novel approach enabled the inventors to provide, using a very simple casement profile 25 that can therefore be manufactured cost-effectively, a high-quality window system usable, for example, in low-energy houses.

In order to protect the adhesive connection 35 from the effect of sunlight, a non-transparent coating 37 can be applied to the edge 16 of the outer window glass 23, at least in the region of the adhesive point. The coating can be applied externally or preferably internally to the surface of the window glass. It is also conceivable externally to attach a length of non-transparent material.

To avoid a cold bridge, the interval between the windowpanes 19, 21 of the stepped glass 15 and the leg 29 of the casement 13 can be filled with an insulating material 38. The insulating material can be introduced in liquid or free-flowing form through an inlet 40 in the casement profile 25. A rebate 34 provided in the first leg 27 of the casement profile 25 is used for receiving a sealing strip 36.

The window sash 12 is articulated in the soffit 39 of a window frame 41. The window frame 41 consists of a window frame profile which is L-shaped in cross section and fitted into a wall soffit 43 of a house wall 44. The window frame 41 consists of a base profile 45 and a soffit panel 47 arranged on the base profile. Two grooves 49, 51, which are arranged at a distance from each other and in which seals 53, 55 are received, are provided on the side of the base profile 41 that is oriented toward the window sash. When the window system 11 is closed, the seals 53, 55 rest against the side 57 of the first leg 27 of the casement profile 25 that is oriented toward the room side so as to produce a seal. It is also conceivable to arrange the seals 53, 55 on the first leg 27.

At least one further seal 59 is provided between the outer windowpane 23 and the outwardly oriented end face 61 of the soffit panel 47. This seal 59 is preferably arranged on the inside of a projection 17 of the outer glass pane 23 beyond the casement 13, although it could also be arranged securely on the soffit panel 47.

An interval 63, in which window fittings (not shown) are received, is provided between the window frame soffit 39 and the casement 13. The window fittings allow the window sash to open outward. The window fittings can in this case include additional functions and, for example, allow lowering and reversing of the window sash 12.

The window system 11 comprising the window frame 41 can be fitted into a wall soffit 43 in a manner known to a person skilled in the art. An insulating layer 65 is conventionally provided between the window frame 41 and the house wall 44. This insulating layer 65 can be inwardly and outwardly sealed by a resilient sealing material 67.

Window fittings (not shown in the figures) arranged on the window frame 41 allow the window sash 12 to be locked in the closed position. Use is preferably made of fittings that allow the window to be locked at least on the underside and upper side, optionally also on all sides (fittings having what are known as corner bearings for corner peripheral closure means). A swivelling lever 14 provided on the casement 13 allows the locking mechanism to be actuated.

Figure 3:
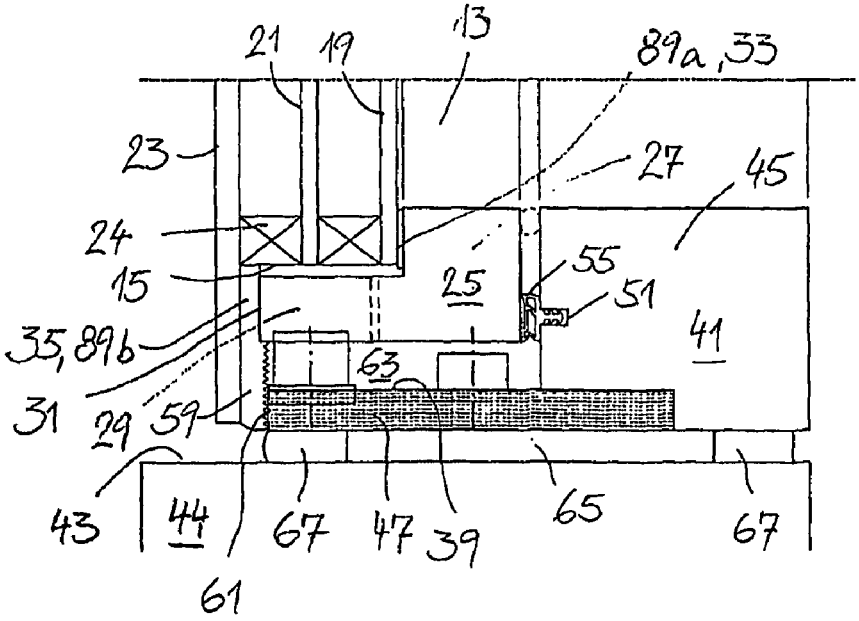
FIG. 3 shows a second embodiment of a window system according to the invention made of wood and having a continuous seal on the inside of the projection of the stepped glazing.

The embodiment of FIG. 3 differs from the example according to FIG. 2 in that the adhesive seals used are continuously foamed seals 89*a*, 89*b*, for example seals consisting of silicone foam. Seals of this type have the advantage of having a low heat conductance value and are therefore also effective insulants. The seal 89*a* is attached to the side of the first leg 27 that is oriented toward the multiple glazing (first adhesive connection 33) and the seal 89*b* to the outwardly oriented end face 31 of the second leg 29 (second adhesive connection 35). The seals 89*a*, 89*b* are bonded to the wood of the casement 13. For this purpose, adhesive layers consisting of suitable adhesives can be applied to the seals.

Figure 4:
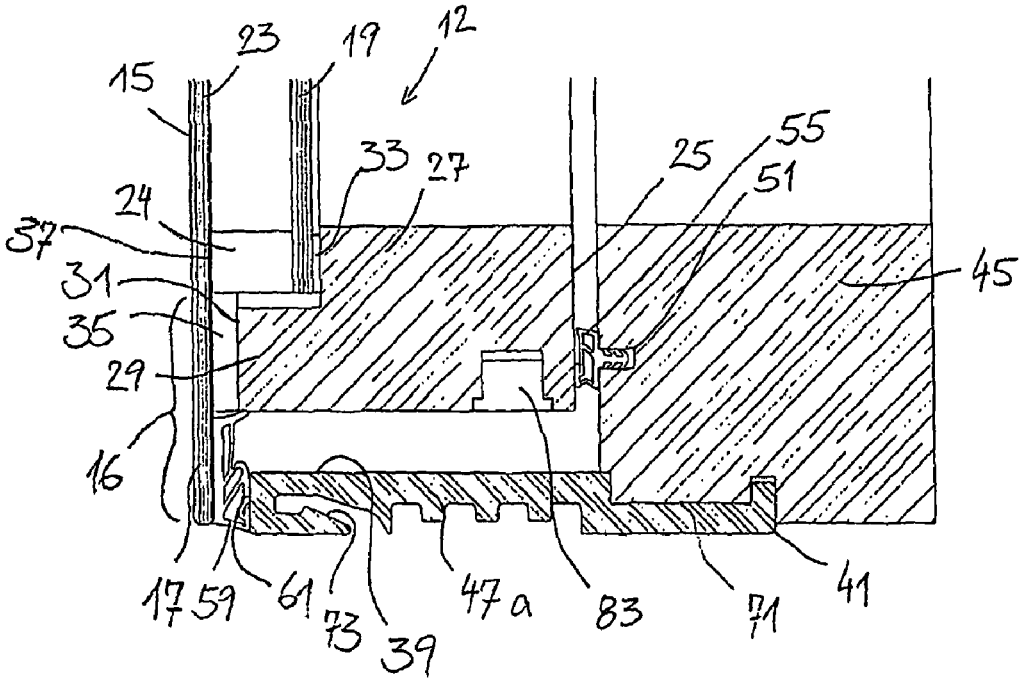
FIG. 4 is a vertical detailed section through a third embodiment of a double-glazed window system according to the invention comprising a casement and a base profile of the window frame made of wood and a soffit leg of the window frame consisting of a plastics material profile.
Figure 5:
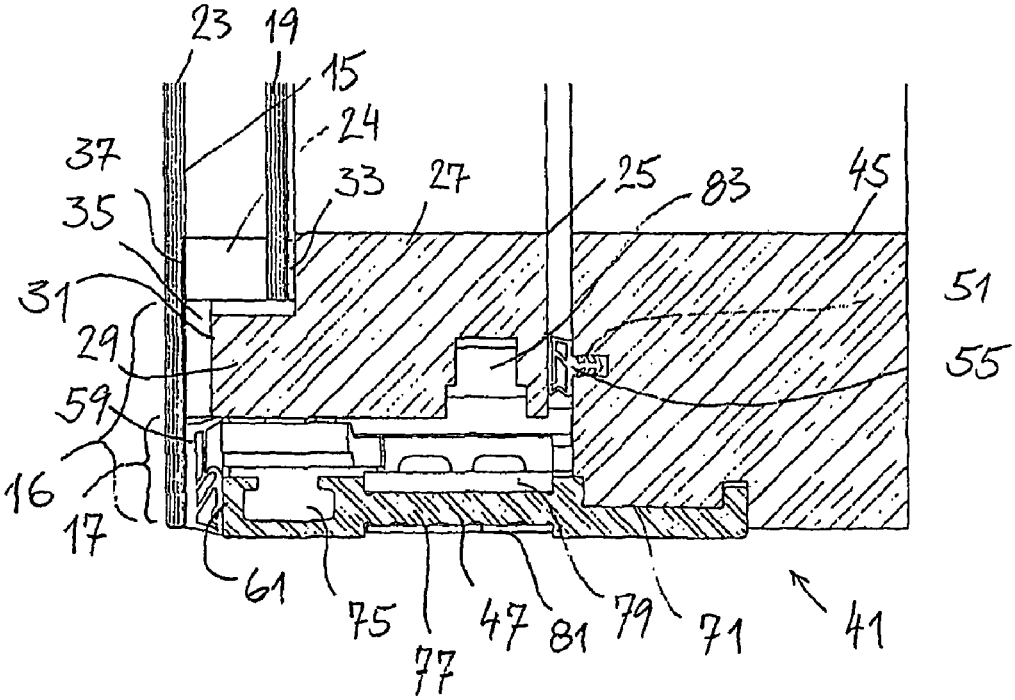
FIG. 5 shows the embodiment according to FIG. 4 but in a horizontal section through the laterally arranged frame profiles.

FIGS. 4 and 5 show a third embodiment in which double insulating glazing, also stepped glazing 15, is provided in the window sash 12. In this embodiment (as also in the other embodiments), the window frame 61 has a base profile 45 consisting of wood. However, the soffit panel 47 is made of a plastics material profile. The plastics material profile of the soffit panel 47 has all of the necessary dimensions of the window frame except for the groove 51 for the sealing profile 55. The base profile 45 therefore has to comprise merely this groove 51 and be customised to the plastics material profile. A cutout 71 is provided in the base profile for the stable joining of the plastics material profile soffit panel 47 and base profile 45. This cutout 71 has a U-shaped configuration which engages with a channel-like portion of the soffit panel 47.

The first dimension of the base profile 45 between the soffit panel and opening of the window frame and also the second dimension of the base profile 45 between the seal to the window sash 12 and the room side of the window frame 41 are adaptable to the respective installation conditions and desires. The first dimension can be smaller than shown in order a) to obtain a shoulder between the opening of the window frame and the casement or b) to attach to the window frame a liner panel which ultimately again has the same clearance as the casement. The second dimension can c) end flush with the inside of the wall, thus allowing a wall liner panel to be guided via the window frame. On the inside of the base profile 45 there can be provided d) a cutout to which a liner panel of this type can connect, for example so as to be surface-flush with or perpendicular to the inside of the window frame. Also, e) a groove can be provided opposing the wall soffit in order to connect the wooden base part 45 to an adjacent wooden stand or an adjacent wooden frame, for example of a further window, via a tongue and groove. The base profile can therefore easily be adapted to the respective conditions and a standard plastics material profile (soffit panel 47), which expediently has constant dimensions for the articulation of the window sash 12, connected thereto.

As may be seen from FIGS. 4 and 5 but also 6 and 7, the horizontal soffit panels 47*a* and the vertical soffit panels 47 differ in terms of their configuration. In the horizontal soffit panels 47*a*, the soffit 39 has a flat surface. The end face 61 is formed by a wall closing a slot 73 open toward the wall soffit. A connection plate can be suspended from this slot.

In contrast thereto, in the plastics material profile 47 provided for the vertical arrangement, a guide rail 75 for a reversible window fitting is provided behind the end face 61. This guide rail 75 is open toward the window sash 12. Guide means, which are provided on the reversible window fitting and with which the upper end of the window sash 12 can be displaced from the upper closed position into a lower reversal position, engage with this guide rail 75. A soffit web 77, which is offset both relative to the wall soffit-side surface of the guide rail 75 and relative to the fitting-side opening in the guide rail 75, is formed between the guide rail 75 and the channel-like portion screwed to the base profile 45. As a result, the fitting can be fastened to this soffit web 77 with a fastening panel 79 on the fitting side of the soffit web 77 and an opposing panel 81 on the wall soffit side of the soffit web 77.

The fittings can be not only reversible fittings but also turning sash fittings, top-hung fittings and sliding fittings. However, it should be noted that these fittings subject the outer seal to little or no shear stress.

Figure 6:
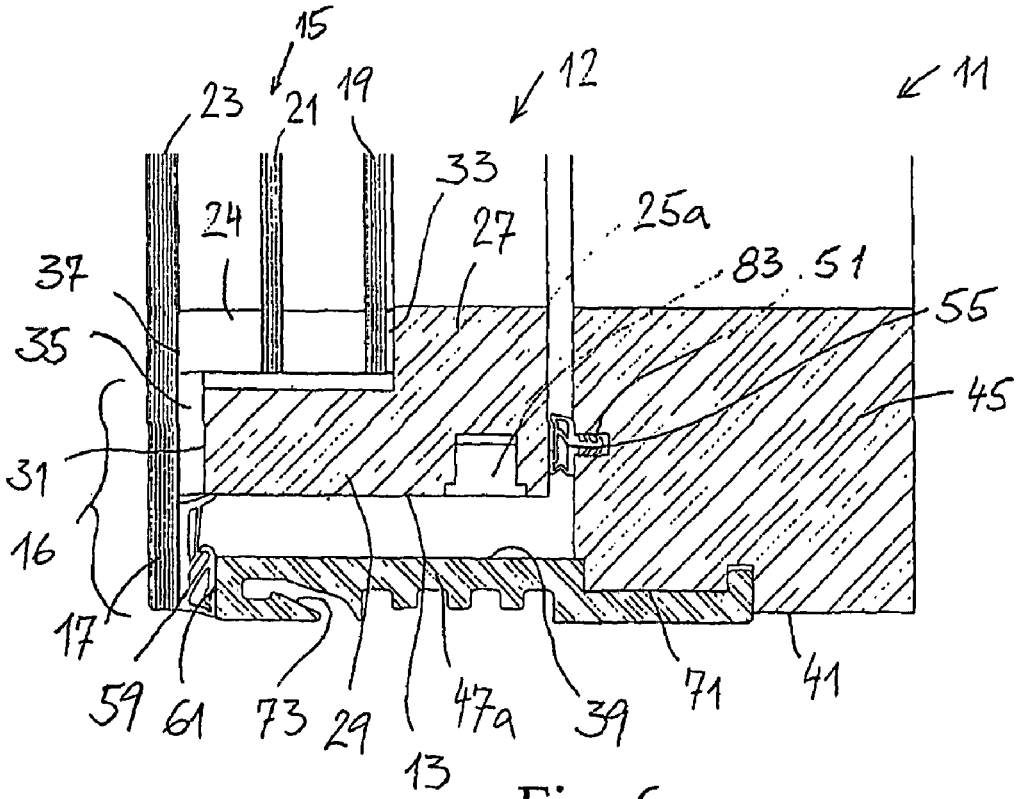
FIG. 6 is a vertical detailed section through a fourth embodiment of a triple-glazed window system according to the invention comprising a casement and a base profile of the window frame made of wood and a soffit leg of the base frame consisting of a plastics material profile.
Figure 7:
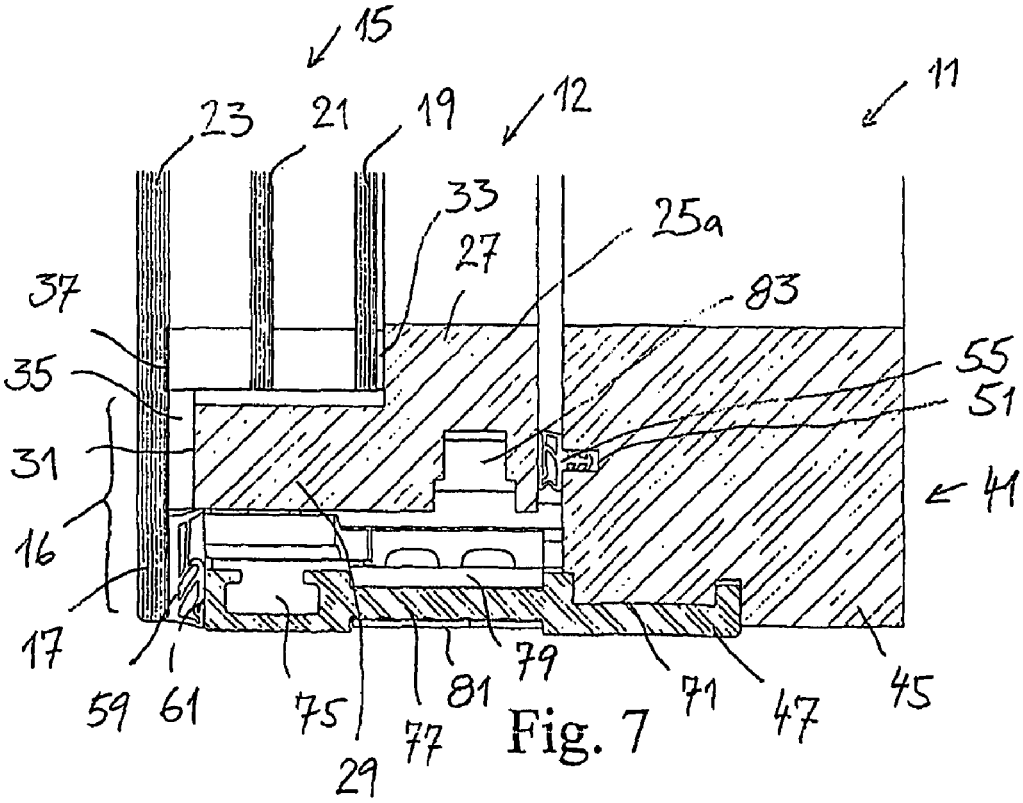
FIG. 7 is a horizontal section of the embodiment according to FIG. 6 through the laterally arranged frame profiles.

FIGS. 6 and 7 show, in contrast to FIGS. 4 and 5, an embodiment comprising triple insulating glazing. All remaining details are of identical configuration. It is noteworthy that the same plastics material profiles can be used as soffit panels 47 for triple insulating glazing as in double glazing. The greater thickness of the glazing is compensated for by the fact that an equally larger rebate is cut out in the casement profile 25*a*.

A locking mechanism 83 is accommodated even in the casement profile 25*a* of minimum size according to FIGS. 6 and 7. The locking mechanism 83 is of conventional peripheral configuration, the lateral rods being sunk somewhat lower in the casement profile 25, 25*a* than the rods in the horizontal casement profiles.

In both embodiments, the glazing consists of stepped glazing. This stepped glazing 15 has two windowpanes 19 and 23 or else three windowpanes 19, 21, 23. Each outer window pane 23 is larger than the other windowpanes 21, 19. The edge 16 of the outer window pane 23 that protrudes beyond the blocking and the blocking itself jointly have almost the same dimensions as the window frame 41. On the inside of the outer window pane 23, the edge 16 is divided into two regions, namely the region of the outer adhesive connection 35 to the casement profile 25 that is adjacent to the blocking, and the projection 17 connecting thereto. Bonded to the projection 17 is a sealing profile 59 which seals the end face 61 of the soffit panel 47 when the window system 11 is closed.

The bonding of the stepped glazing 15 to the wooden casement 13 comprises two differing adhesive connections 33, 35. The inner adhesive connection 33 is used primarily for stabilising the window frame 13 as a result of the bonding to the angularly fixed inner windowpane 19. It also causes the casement, as a result of the improved linking to the glazing, to warp less during locking and handling of the window knob 14 and not to become detached from the inner windowpane. The inner adhesive connection during fitting also promotes precise fixing of the stepped glazing 15 to the casement 13. This inner adhesive connection 33 is therefore preferably produced via an adhesive strip. The adhesive strip ensures a clean joint between the glazing 15 and casement 13, as no liquid adhesive is able to issue from this joint and the adhesive strip can be attached precisely to the casement profile 25 along the glazing-side edge of the first leg 27. Once the casement 13 and stepped glazing 15 have been joined, the opposing position of these two parts is fixed immediately, as the bonding of the adhesive strip does not require any drying time or setting time.

The outer adhesive connection 35, on the other hand, absorbs primarily those forces acting between the glazing and casement. This outer adhesive connection 35 is preferably not produced until the position of the casement 13 has been fixed relative to that of the stepped glazing 15. In order to allow this second adhesive connection 35 to be of the desired quality, the second leg 29 of the casement profile 25 is shorter than the thickness of the stepped glazing between the outside of the inner windowpane 19 and the inside of the outer windowpane 23. This produces an adhesive gap between the inside of the edge 16 and the end face 31 of the second leg 29 having a width of from 3 to 6 millimetres. A preferred gap width is from 4 to 5 millimetres. An adhesive gap of this type can be filled from the open narrow side with a viscous adhesive, for example a two-component adhesive. Owing to the fixing via the first adhesive connection 33, this outer adhesive connection 35 can require a certain period of time to set and to cure without any risk of the glazing becoming displaced relative to the frame during this type.

The outer adhesive connection 35 has proven fundamental with regard to the sound insulation of the window system. Triple glazing is preferred for high heat insulation values. For high sound insulation values, a relatively softly curing adhesive is provided in the outer adhesive connection 35, irrespective of the number of windowpanes of the stepped glazing 15. For high sound insulation values, the Shore hardness of the adhesive is hardness A. An adhesive of hardness A has, for example, a combined tension and shear resistance of from 1 to 3 MPa. For applications requiring higher combined tension and shear resistances, for example window panes having a very large surface area, high wind load, etc., adhesives having higher combined tension and shear resistances, for example from 9 to 12 MPa, can be used. Such an adhesive has, for example, a Shore hardness D. A window thus bonded absorbs less sound than a window bonded using a softer adhesive.

The manufacturing method will now be described, by way of example, with reference to the manufacture of an outwardly opening wooden reversible window. Firstly, the casement is provided in the form of an L-shaped casement profile 13 having first and second legs 27, 29. The casement profiles are arranged in such a way that the first legs of opposing profiles 25 are oriented toward one another in a single plane. Stepped glazings are known and can be obtained from appropriate manufacturers in the desired size. Both the stepped glazing and the casement are cleaned at the adhesive points provided and preferably treated with a primer to improve the adhesion of the adhesives. It is also conceivable to grind (sandblast) the windowpane at the adhesive point provided in order to roughen the surfaces and to improve the adhesion.

The casement is preferably arranged on a horizontal base and a double-sided adhesive strip 33 attached to the side of the first leg 27 of the L-shaped profile that is oriented toward the glazing. The stepped glazing is then placed into the frame. Alternatively and preferably, the casement 13 is positioned via the stepped glazing 15 at a distance from the inner windowpane 19, adjusted relative to the stepped glazing and then pressed against it. The gap remaining between the end face 31 of the second leg 29 and the inside of the outer windowpane is then filled with a free-flowing adhesive. The adhesive point is left to cure for the requisite time.

The cavity remaining in the window sash between the casement and the central and inner window glass can then be filled with an insulating material. A sprayable or free-flowing adhesive, which is also left to cure, is preferably introduced through an inlet 40 provided in the casement 13. It has been found that the cavity does not need to be filled, without thereby causing any drawback. A vent is provided in the cavity to prevent condensation of water.

A flat rubber seal 59 is arranged on the inside of the projection 17 of the outer windowpane 23 that is oriented toward the room side via the casement 25. The rubber seal outwardly seals the window sash to the window frame. The window sash 12 can then be provided with window fittings and inserted into a corresponding window frame 41.

In conclusion, it can be stated that an outwardly opening window 11, in particular a reversible window, has a casement 13 and stepped glazing 15 received in the casement 13. The stepped glazing 15 has at least two windowpanes 19, 23, an inner and an outer windowpane, arranged at a distance from one another. The casement 13 is formed substantially by an L-shaped casement profile 25 having a first and a second leg 27, 29. The inner windowpane 19 rests against the side of the first leg 27 of the casement profile 25 that is oriented toward the glazing and is rigidly connected thereto by means of a first adhesive connection 33. The outer windowpane 23 of the stepped glass is rigidly connected to the outwardly oriented end face 31 of the casement profile 25 via a second adhesive connection 35. The layer thickness of the second adhesive connection 35 is greater than that of the first adhesive connection 33. The first adhesive connection 33 is advantageously achieved by an adhesive strip, although the second is advantageously achieved by a liquid adhesive.

LEGEND

11 Window system comprising a window frame, window sash, stepped glazing and fitting
12 Window sash
13 Casement
14 Swivelling lever, window knob
15 Stepped glazing
16 Edge of the outer windowpane 23 of the stepped glazing 15 that protrudes beyond the blocking
17 Projection of the stepped glazing beyond the casement 13
19 Inner windowpane
21 Central windowpane
23 Outer windowpane
24 Spacer between the windowpanes
25 L-shaped casement profile
27 First leg of the casement profile
29 Second leg of the casement profile, located perpendicularly to the first leg
31 Outwardly oriented end face 31 of the second leg 29
33 First, inner adhesive connection
34 Rebate in the first leg 27
35 Second, outer adhesive connection
36 Sealing strip
37 Non-transparent coating
38 Insulating material
39 Window frame soffit (on the soffit panel 47)
41 Window frame
43 Soffit of the wall opening
44 House wall
45 Base profile of the window frame 41
47 Soffit panel
49, 51 Grooves
53, 55 Seals
57 Inwardly oriented side of the base leg 27
59 Seal
61 Outwardly oriented end face of the soffit panel 47
63 Interval between the soffit panel and casement
65 Insulating layer
67 Resilient sealing material
71 Cutout for the soffit panel in the base profile 41
73 Outer slot in the soffit panel
75 Guide rail in the soffit panel
77 Soffit web of the soffit panel
79 Panel for fastening the fitting
81 Panel opposing the fastening panel 79
83 Locking mechanism
89*a, b* Foamed adhesive seals

The invention claimed is:

1. A window sash comprising a casement formed substantially by an L-shaped casement profile having a first leg and a second leg, the first legs of opposing casement profiles being oriented toward one another; and stepped glazing received in the casement and having at least two windowpanes which are set apart from one another by at least one space and the insides of which are arranged facing one another and the outsides of which are arranged remote from one another, comprising an inner windowpane and an outer windowpane, which outer windowpane has a single edge protruding beyond the inner windowpane, the inside of which edge is rigidly connected to an end face of the second leg of the casement profile by an outer adhesive connection, wherein whereby the outside of the inner windowpane of the stepped glazing is rigidly connected to the first leg of the casement profile by an inner adhesive connection, wherein the first leg has an end edge extending along the inner windowpane and in that there is provided between the end edge and the inner windowpane a rebate in the casement, in which a sealing strip or a sealing compound is received.

2. The window sash according to claim 1, wherein the outer adhesive connection forms a more resilient connection between the stepped glazing and the casement than the inner adhesive connection.

3. The window sash according to either claim 1, wherein a rebate depth, defined by the second leg, of the casement profile is smaller than the thickness of the stepped glazing less the thickness of the outer windowpane and in that the outer adhesive connection has a greater layer thickness than the inner adhesive connection.

4. The window sash according to claim 1, wherein an adhesive of the inner or outer adhesive connection has at most a Shore hardness of A 90 or D 50.

5. The window sash according to claim 1, wherein an adhesive of the inner or outer adhesive connection has a combined tension and shear resistance of greater than 1 MPa but at most 12 MPa.

6. The window sash according to claim 1, wherein the outer adhesive connection, is formed by a heat-reactive polyurethane adhesive.

7. The window sash according to claim 1, wherein the outer adhesive connection, is formed by a two-component adhesive, in particular an acrylate reactive adhesive.

8. The window sash according to claim 1, wherein the inner adhesive connection, is formed by a double-sided adhesive strip.

9. The window sash according to claim 1, wherein the edge of the outer windowpane is provided with an opaque layer or coating, at least in the region of the adhesive connection.

10. The window sash according to claim 1, wherein the casement profile is a hollow profile.

11. The window sash according to claim 1, wherein the casement profile is a plastics material profile, in particular a plastics material profile reinforced by a metal profile.

12. The window sash according to claim 1 further comprising a window frame to which the window sash is pivotably articulated by window fittings.

13. The window sash according to claim 12, wherein the length and the width of the window frame substantially correspond to the length and width of the outer windowpane.

14. The window sash according to claim 11, wherein an opening of the window frame and an opening of the casement and, in particular, also an opening of the stepped glazing correspond in alignment.

15. The window sash according to claim 12, wherein the window frame has an L-shaped configuration, a base leg extending parallel to the first leg of the casement and a soffit leg extending from the base leg up to the outer windowpane.

16. The window sash according to claim 15, wherein between the soffit leg of the L-shaped window frame and the L-shaped casement profile is defined an interval in which window fittings are received.

17. The window sash according to claim 12, wherein the edge of the outer windowpane forms a projection protruding beyond the casement profile and rests with the projection against an end face of the soffit leg of the window frame when the window is closed.

18. The window sash according to claim 17, wherein a sealing path is provided on the side of the projection that is oriented toward the window frame.

19. The window sash according to claim 12, wherein at least one groove for receiving a seal is provided on a side of the base profile of the window frame that is oriented toward the window sash.

20. The window sash according to claim 14, wherein the soffit leg is formed by a plastics material profile.

21. The window sash according to claim 20, wherein vertically arranged soffit legs are formed by a first plastics material profile having a guide rail for the fitting and at least a lower of horizontally arranged soffit legs is formed by a plastics material profile configured for a sheet metal flashing.

* * * * *